US006149331A

United States Patent [19]

Raps et al.

[11] Patent Number: 6,149,331

[45] **Date of Patent: *Nov. 21, 2000**

[54] REFILLABLE SOFT LEAD PENCIL

[75] Inventors: Juergen Raps, Hof; Werner Zahn, Geroldsgruen, both of Germany

[73] Assignee: A. W. Faber-Castell Unternehmensverwaltung GmbH & Co., Stein, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/051,044

[22] PCT Filed: Jul. 30, 1997

[86] PCT No.: PCT/EP97/04144

§ 371 Date: Mar. 31, 1998

§ 102(e) Date: Mar. 31, 1998

[87] PCT Pub. No.: WO98/05235

PCT Pub. Date: Feb. 12, 1998

[30] Foreign Application Priority Data

Aug. 1, 1996 [DE] Germany ..... 196 30 906

[51] Int. Cl.[7] ..... A45D 40/06; A45D 40/20

[52] U.S. Cl. ..... 401/75; 401/68; 401/116

[58] Field of Search ..... 401/75, 74, 76, 401/70, 68, 116

[56] References Cited

U.S. PATENT DOCUMENTS

| | | | |
|---|---|---|---|
| 1,916,199 | 7/1933 | Back | 401/76 |
| 5,018,892 | 5/1991 | Krueckel et al. | 401/75 X |
| 5,364,197 | 11/1994 | Powers | 401/75 |
| 5,366,311 | 11/1994 | Powers | 401/75 X |
| 5,423,623 | 6/1995 | Bakic | 401/75 X |
| 5,547,300 | 8/1996 | Powers | 401/75 X |

FOREIGN PATENT DOCUMENTS

96/18323 6/1996 WIPO .

*Primary Examiner*—Henry J. Recla
*Assistant Examiner*—Kathleen J. Prunner
*Attorney, Agent, or Firm*—Venable; George H. Spencer; Ashley J. Wells

[57] ABSTRACT

A pencil which has a tip and which dispenses a soft mass in use includes a sheath having front and back ends; a push rod positioned coxially within the sheath, having a sheath-side end, and being secured by its sheath-side end to the back end of the sheath in an axial direction; an elongate soft mass insert position coxially with the sheath; a front part which is a sleeve that envelopes the soft mass insert over at least a portion of its length, which is positioned coxially with the sheath and accommodated at least in part within the sheath, and which operates jointly with the sheath in the manner of a helical gear so that the fromt part retracts into the sheath by turning the front part relative to the sheath; and a soft mass insert holder which is connected to the front part so that it is engaged in the turning moment of the front part, which holds the elongate soft mass insert by one end thereof, which is rotatably secured to the push rod, and which is immovably secured to the push rod in the axial direction.

15 Claims, 4 Drawing Sheets

REFILLABLE SOFT LEAD PENCIL

BACKGROUND OF THE INVENTION

1. Field of the Invention

The invention relates to a pencil, in particular a pencil for dispensing a soft mass for cosmetic purposes.

2. Description of the Related Art

Such pencils comprise a sleeve-like sheath with a front end and a back end, a push rod that is arranged coaxially inside the sheath and is secured with one end in axial direction to the back end of the sheath, as well as a soft mass insert that is connected to the free end of the push rod. The sheath and the front part are rotatably connected, in the manner of a helical gear. The front segment can be retracted telescopically into the sheath through a relative turning of the aforementioned parts. The front part then releases the soft mass insert, secured relative to the sheath in axial direction. Such pencils for dispensing a soft mass are described, for example, in the references U.S. Pat. No. 5,364,197 and U.S. Pat. No. 5,366,311. In addition to the axial movement, the front part of the known pencils for dispensing a soft mass also performs a turning movement, relative to the soft mass insert, during the extending or retracting movement. Owing to the frequently sticky and soft consistency, the soft mass insert can stick to the inside of the front part, especially if it has not been used for some time. If the front part is retracted in that case, it is possible that the soft mass insert will shear off as a result of the relative turning movement between front part and soft mass insert.

SUMMARY OF THE INVENTION

Based on this, it is the object of the invention to improve a pencil of the aforementioned type with respect to this problem. This object is solved in that the soft mass insert is connected rotatably to the push rod. If the soft mass insert sticks completely or only in some parts to the inside surface of the front part, this does not have an adverse effect, at least not during the retracting movement of the front part, since the soft mass insert can turn along with the front part as a result of being rotatably secured to the push rod. A shearing off of the soft mass insert is thus prevented. A design according to the invention makes sense even for pencils where the front part and the sheath are connected such that they turn together and where the push rod, which is configured as a helical spindle and operates jointly with the front part, is located rotatably inside the sheath.

The soft mass insert of one preferred embodiment is held by the end of a soft mass insert holder, which points toward the pencil tip. The other end of the soft mass insert holder is rotatably secured to the push rod, wherein the soft mass insert holder is connected such that it engages in the turning moment of the front part. Such a design ensures that a shearing off of the soft mass insert is prevented, even with masses of a very soft consistency. The soft mass insert in this case does not turn along because of a frictional or material engagement between soft mass insert and front part, but preferably because of a form-locking engagement between front part and soft mass insert holder, which is effective in turning direction. The rotatable connection between soft mass insert holder and the tip-side end of the push rod is achieved with a very simple design, which is particularly easy to assemble in that a circular positioning groove exists on the inside surface of the sheath-side segment of the soft mass insert holder, into which an annular projection, arranged on the tip-side end of the push rod, engages in the manner of a snap connection.

In one preferred embodiment, the connection between sheath and front part in the manner of a helical gear is designed such that the push rod is rotatably secured to the sheath and has an external thread, into which the front part engages. It is particularly advantageous with respect to the technical assembly if a snap connection with axially extending joining direction is effective between the external thread of the push rod and the front part. Such a snap connection is advantageously realized in that a gripping jaw is formed onto the sheath-side end of the front part, which is engaged in the external thread of the push rod and is elastically preformed in engagement direction.

BRIEF DESCRIPTION OF THE DRAWINGS

In the following, the invention is explained in further detail with the aid of-the attached drawings. Shown are in.

DESCRIPTION OF THE PREFERRED EMBODIMENTS

Figure 1:
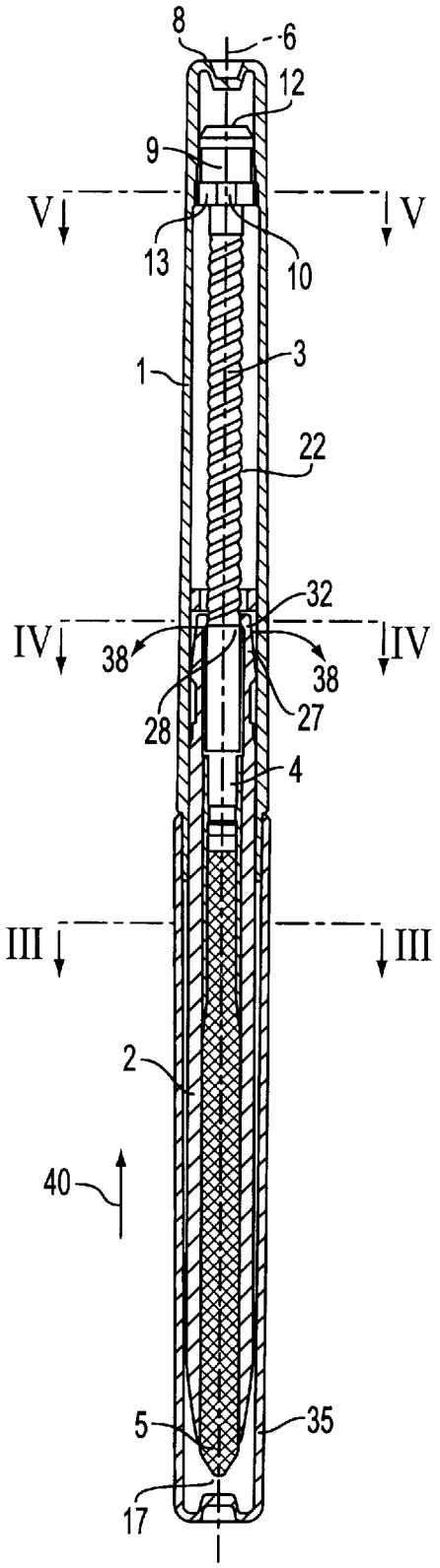
FIG. 1 A longitudinal section of a pencil according to the invention.
Figure 2:
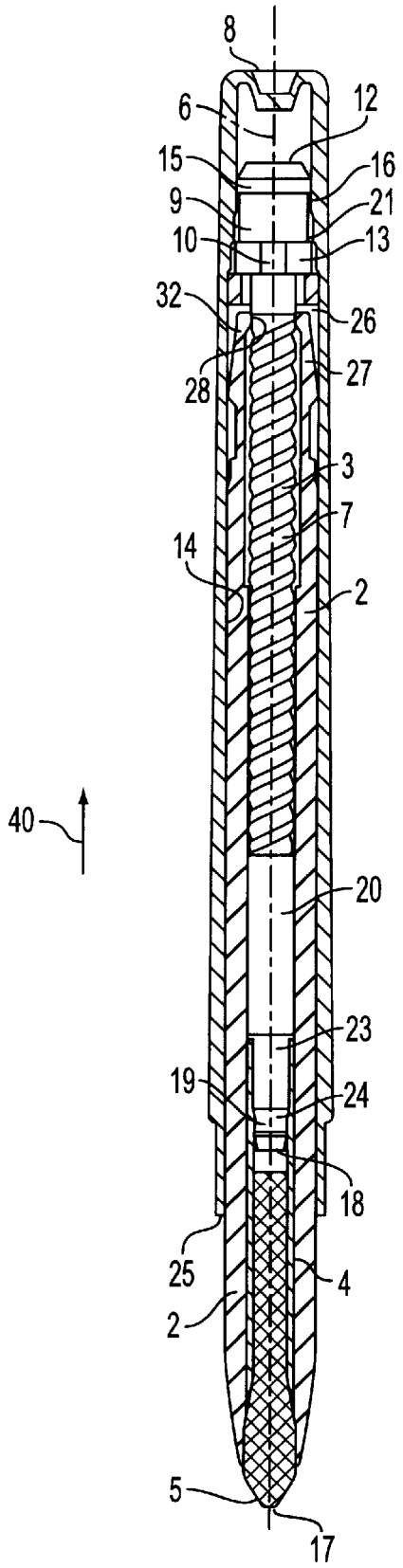
FIG. 2 The longitudinal section of a pencil according to FIG. 1, with a soft mass insert shortened through use and where the front part is retracted into the sheath.
Figure 5:
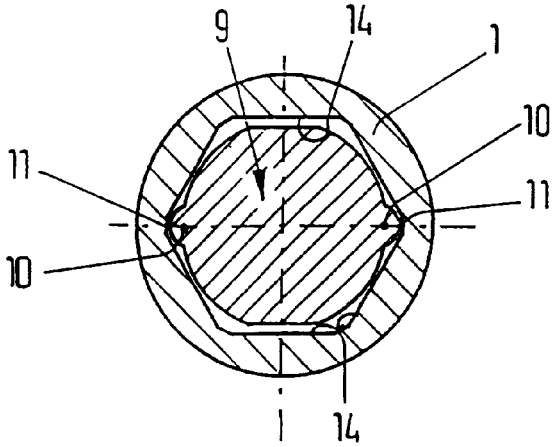
FIG. 5 A cross section along the line V—V in FIG. 1.
Figure 6:
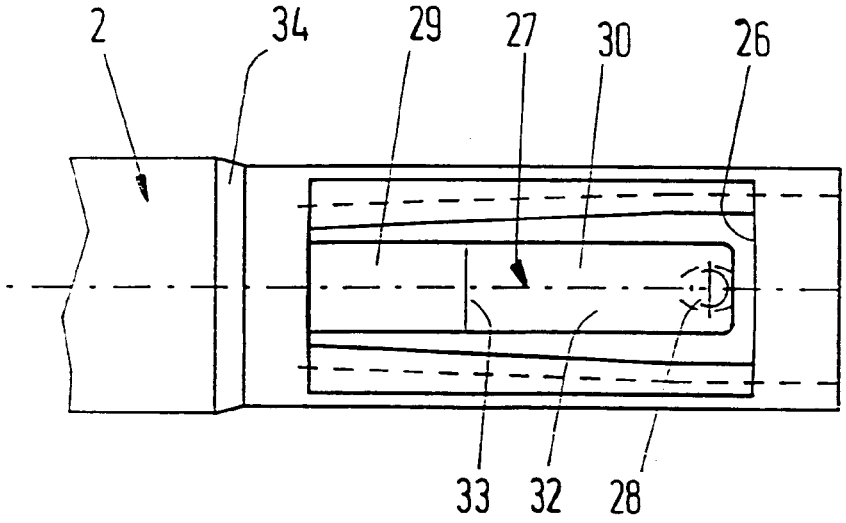
FIG. 6 The end of the front part of a pencil according to the invention, which operates jointly with the push rod.

As can be seen in FIG. 1 and in particular in FIG. 2, the main components of a pencil according to the invention are a sleeve-type sheath 1, a sleeve-type front part 2, a push rod 3, a soft mass insert holder 4 and a soft mass insert 5. The push rod 3 is an essentially cylindrical part with a helical groove 7 that extends screw-like around its longitudinal center axis 6 and forms an external thread. The back end of sheath 1 is closed off by a bottom 8, while its front end is open to receive the front part 2. When completely assembled, back end 12 of push rod 3, which faces the sheath bottom 8, has a segment with larger diameter, namely, a head piece 9. A flange 13 is arranged at a distance in front of the back end 12 of push rod 3, which flange has two lock-in projections 10, positioned diametrically opposite each other on its circumferential surface. The lock-in projections 10 engage in lock-in recesses 11 (FIG. 5) with a complimentary shape on the inside surface 14 of sheath 1. As a result of this design, the push rod 3 is secured against rotation, relative to the sheath 1. A securing in the axial direction is effected by an annular projection 15, arranged at a distance to the flange-type enlargement and near the end 12. On the side facing the flange 13, this annular projection is gripped from behind by a ring-shaped locking projection 16 that projects from the inside surface 14 of sheath 1. The flange 13 rests against a stop collar 21 that points toward the pencil tip 17 and projects radially inward from the inside surface 14.

There is no external thread on the end region of push rod 3, which faces the pencil tip 17. This end region is divided into a first region 20, which follows the external thread or helical groove 7, and an adjoining second region 23 that extends to the end 18 of the push rod. The diameter of the first region 20 corresponds to the diameter of the push rod region provided with an external thread. The second region has a smaller diameter and is used to fasten the soft mass insert holder 4. The soft mass insert holder 4 is essentially a sleeve, one end of which is fitted during the assembly onto the second region 23 of push rod 3. Thus, when fully assembled, the region 23 is enveloped by the one end of the soft mass insert holder 4. In order to secure it in axial direction, a radially inward pointing annular projection 24 is arranged on the inside of the soft mass insert holder, which, when the device is fully assembled, engages in a constriction 19 of the second region 23, in the manner of a snap connection. As a result of this design, the soft mass insert holder 4 is secured in the axial direction, but is rotatably connected with the push rod 3. With one of its ends, the soft mass insert 5 is inserted axially and secured against rotation in the region of soft mass insert holder 4, which extends away from the annular projection 24 and in the direction of pencil tip 17. The soft mass insert holder 4 essentially has the same diameter as the first region 20. The push rod 3 and the soft mass insert holder 4 are arranged in the sheath center, wherein the soft mass insert holder 4 projects in part from the sheath or the sheath opening 25, arranged on the front end facing away from the sheath bottom 8.

A hollow-cylinder shaped receiving space 22 for receiving the front part 2 is arranged between the inside surface 14 of sheath 1 and the outside circumferential surface of the push rod 3 and soft mass insert holder 4. When assembled, the front part 2 is positioned at least partially in the receiving space 22 and envelopes the push rod 3, the soft mass insert holder 4 and the soft mass insert 5, meaning it is arranged coaxially to these parts.

Figure 3:
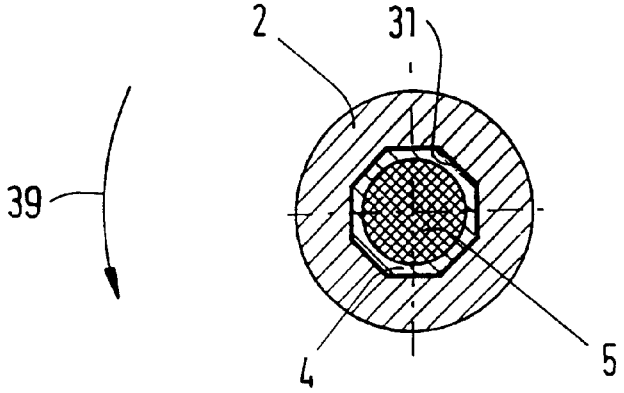
FIG. 3 A cross section along the line III—III in FIG. 1.

FIG. 3 shows that the soft mass insert holder 4, as seen in the cross section, has an octagonal contour. The inside surface 31 of the front part 2 has a complementary design, meaning the pencil insert holder 4 is embedded in the front part 2, such that it is form-locking in a turning direction.

The end of front part 2, which is embedded in sheath 1 or which faces the sheath bottom 8, has two windows 26 that are positioned diametrically opposite each other. These windows are approximately U-shaped and circumscribe respectively one gripping jaw 27 extending in axial direction, the free end of which points toward the sheath bottom 8. The gripping jaws 27 have respectively one lock-in cam 28 on the inside facing the push rod 3, which cam engages in the helical groove 7. The front part 2 is connected in this way to the movement of push rod 3 in the manner of a spindle drive. The gripping jaws 27 have a first segment 29 and a second segment 30. The second segment 30 adjoins the first segment 29 and extends to the free end of the gripping jaws 27. The upper surface 32 of segment 30 is beveled toward the free end of the gripping jaws 27. In the assembled state, only the region 33 of segment 30, which adjoins the first segment 29, rests against the inside surface 14 of sheath 1. The wall thickness of the first segment 29 is less than that of the second segment 30. The end region of the front part 2 with the gripping jaws 27 turns via a slanted shoulder 34 into a region with a larger diameter, the outside circumferential surface of which cooperates with the inside surface 14 of the sheath in the sense of a sliding guide.

Figure 4:
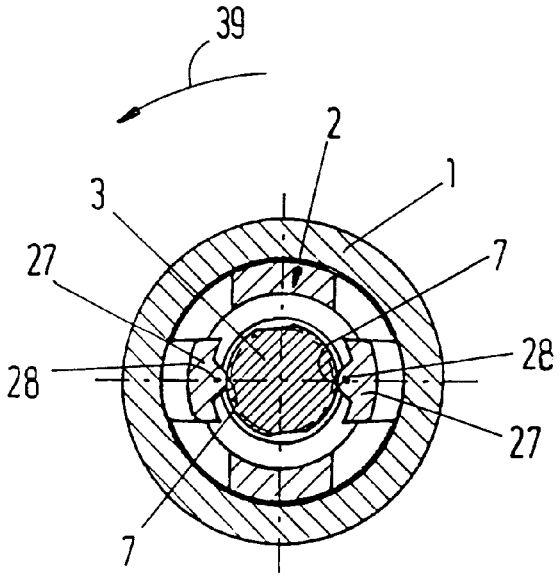
FIG. 4 A cross section along the line IV—IV in FIG. 1.

The operation of a pencil according to the invention is explained in the following: Starting with the situation as shown in FIG. 1, a protective cap 35, which may have been fitted onto the sheath 1, is initially removed. The front part is in a maximum extended position. The lock-in cams 28 in this case are arranged on the tip-side end of the helical groove 7. The soft mass insert 5, which has not yet been used, is long enough so that its end projects from the front part 2. Once the projecting end is used up, the sheath 1 and the front part 2 are turned relative to each other, in that the sheath 1 is held in place, for example, and the front part is turned in turning direction 39 (FIGS. 3, 4). The soft mass insert 5 turns along in turning direction 39, since the soft mass insert holder 4 on the one hand is rotatably connected to the push rod 3 and, on the other hand, is embraced in a form-locking way by the front part, such that it effectively turns in direction 39. A shearing off of the soft mass insert 5 as a result of a turning relative to the front part is thus prevented. The lock-in cams 28 move along the helical groove 7, so that the front part 2 is moved in a retracting direction 40. Sheath 1 and front part 2 are turned in opposite directions until the soft mass insert once more has a sufficiently projecting end. The front part 2 can be moved in the retracting direction 40 until its end facing the sheath hits the head piece 9 of push rod 3, as shown in FIG. 2. In order to extend the front part, it is turned relative to the sheath and counter to the turning direction 40.

The assembly of a soft mass insert according to the invention takes place as follows: First of all, the soft mass insert holder 4 with a soft mass insert 5 is fitted onto the push rod 3. The inserting movement in this case is in the direction of the longitudinal center axis 6 of the push rod or the soft mass insert holder and the soft mass insert. At the completion of fitting-on movement, the annular projection 24 on the soft mass insert holder 4 snaps into the constriction 19 of the push rod 3. Following this, the front part 2 is pushed from the pencil tip 17 over the soft mass insert 5 and finally over the soft mass insert holder 4, until the gripping jaws 27 with their lock-in cams 28 engage into the helical groove 7. When fitting the front part 2 onto the soft mass insert holder 4, the gripping jaws 27 are deflected radially toward the outside, in the direction of arrows 38. The segments 29 of the gripping jaws, which have reduced wall thickness, in this case act so-to-speak as foil hinges. In a final step, the sheath 1 is fitted onto the end 12 of push rod 3. At the end of this inserting movement, the flange 13 hits against the stop surface 21 on the inside surface 14 of sheath 1.

What is claimed is:

1. A pencil which has a tip and which dispenses a soft mass in use, comprising:

a sheath having fromt and back ends;

a push rod positioned coaxially within the sheath, having a sheath-side end, and being secured by its sheath-side end to the back end of the sheath in an axial direction;

an elongate soft mass insert positioned coxially with the sheath;

a front part which is a sleeve that envelopes the soft mass insert over at least a portion of its length, which is positioned coaxially with the sheath and accommodated at least in part the sheath, and which operates jointly with the sheath in the manner of a helical gear so that the front part retracts into the sheath by turning the front part relative to the sheath; and a soft mass insert holder which is connected to the front part so that it is engaged in the turning moment of the front part, which holds the elongate soft mass insert by one end thereof, which is rotatably secured to the push rod, and which is immovably secured to the push rod in the axial direction.

2. The pencil according to claim 1 wherein the soft mass insert holder is a sleeve, wherein the elongate soft mass insert is inserted with its sheath-side end in the segment of the soft mass insert holder which faces the pencil tip and which is enclosed by the front part in a form-locking way that is effective in a turning direction.

3. The pencil according to claim 2, wherein a radially inward pointing annular projection is arranged on the inside surface of the section of the soft mass insert holder that faces the sheath, which projection engages in the manner of a snap connection into a constriction, arranged on the tip-side end of the push rod.

4. The pencil according to claim 3, wherein the push rod is attached to the sheath such that it rotates with the sheath, and wherein the push rod has a helical groove in its circumferential surface that forms an outside thread into which the front part engages.

5. The pencil according to claim 4, characterized by a snap connection that is effective between the helical groove and the front part and for which the joining direction extends in axial direction.

6. The pencil according to claim 5, characterized by at least one gripping jaw that is formed onto the sheath-side end of the front part, is engaged in the helical groove and is elastically prestressed in an engagement direction.

7. The pencil according to claim 2, wherein the push rod is attached to the sheath such that it rotates with the sheath, and wherein the push rod has a helical groove provided in its circumferential surface that forms an outside thread into which the front part engages.

8. The pencil according to claim 7, characterized by a snap connection that is effective between the helical groove and the front part and for which the joining direction extends in axial direction.

9. The pencil according to claim 8, characterized by at least one gripping jaw that is formed onto the sheath-side end of the front part, is engaged in the helical groove and is elastically prestressed in engagement direction.

10. The pencil according to one of the claim 1, wherein the push rod is attached to the sheath such that it rotates with the sheath, and wherein the push rod has a helical groove provided in its circumferential surface that forms an outside thread into which the front part engages.

11. The pencil according to claim 10, characterized by a snap connection that is effective between the helical groove and the front part and for which the joining direction extends in the axial direction.

12. The pencil according to claim 11, characterized by at least one gripping jaw that is formed onto the sheath-side end of the front part, is engaged in the helical groove and is elastically prestressed in an engagement direction.

13. The pencil according to claim 1, wherein the push rod is attached to the sheath such that it rotates with the sheath and that it has a helical groove provided in its circumferential surface that forms an outside thread into which the front part engages.

14. The pencil according to claim 13, characterized by a snap connection that is effective between the helical groove and the front part and for which the joining direction extends in axial direction.

15. The pencil according to claim 14, characterized by at least one gripping jaw that is formed onto the sheath-side end of the front part, is engaged in the helical groove and is elastically prestressed in engagement direction.

* * * * *